United States Patent [19]

Schroeder

[11] 3,978,340

[45] Aug. 31, 1976

[54] LUMINESCENT BACKING SHEET FOR READING AND WRITING IN THE DARK

[76] Inventor: Becky J. Schroeder, 2317 Valleybrook Drive, Toledo, Ohio 43615

[22] Filed: Apr. 11, 1975

[21] Appl. No.: 567,397

Related U.S. Application Data

[63] Continuation-in-part of Ser. No. 498,705, Aug. 19, 1974, Pat. No. 3,879,611, which is a continuation-in-part of Ser. No. 428,339, Dec. 26, 1973, which is a continuation of Ser. No. 288,148, Sept. 11, 1972, abandoned.

[52] U.S. Cl. ..... 250/462; 250/486; 35/37

[51] Int. Cl.[2] ..... H01J 1/62

[58] Field of Search ..... 250/462, 486; 35/36, 35/37, 38

[56] References Cited

UNITED STATES PATENTS

| | | | |
|---|---|---|---|
| 2,413,459 | 11/1946 | Lynch | 250/486 |
| 3,879,611 | 4/1975 | Schroeder | 250/462 |

FOREIGN PATENTS OR APPLICATIONS

| | | | |
|---|---|---|---|
| 559,124 | 2/1944 | United Kingdom | 250/462 |
| 559,603 | 2/1944 | United Kingdom | 250/462 |

*Primary Examiner*—Archie R. Borchelt

[57] ABSTRACT

A phosphorescent backing sheet for use in underlying relation with light transmitting writing sheets, drawing sheets or sheets having reading or other intelligible matter thereon in lines thick enough to permit a person to read in the dark as well as write in the dark.

6 Claims, 7 Drawing Figures

LUMINESCENT BACKING SHEET FOR READING AND WRITING IN THE DARK

This is a continuation-in-part of my co-pending application Serial No. 498,705, filed August 19, 1974, now U.S. Patent No. 3,879,611 which is a continuation-in-part of my application Serial No. 428,339, filed December 26, 1973, which was a continuation of my application Serial No. 288,148, filed September 11, 1972, now abandoned.

This invention relates to an auxiliary or backing sheet for use with writing paper to permit a writer to write legibly by hand in orderly straight line form in the dark.

If one attempts to write in the dark, I have found that although the mechanics of writing can be accomplished with little more than usual effort, writing in straight lines with uniform spacing between lines and without overlap is difficult in the absence of some guide means. According to my present invention I have found that guide lines for material written in the dark can be provided with very little light, and that as little light as is given off by a backing sheet having phosphorescent lines applied thereto is all that is necessary to enable one to write with a pencil or pen in orderly and neat form in the dark.

Furthermore, I have found that when a sheet, to which lines of commercially available phosphorescent paint is applied, is charged by even a brief exposure to light, may be seen clearly in the dark through one or more sheets of ordinary writing paper. For example, I have found that a one minute charge of light from an ordinary light bulb will provide visible phosphorescent lines which can be seen through ordinary writing paper in the dark for periods of 15 minutes or more.

In this regard, the invention becomes useful in laboratory work where observations are to be conducted in the dark. The invention can be used also in outer space travels where, as in recent travels of astronauts, the electrical systems of the spacecraft were required to be shut down for planned periods to permit recharging of equipment. Still further, the invention has practical value in writing in automobiles after dark without need for internal lighting which has a tendency to distract and disturb the driver.

In view of the foregoing it is an object of the present invention to provide means in the form of a luminescent backing sheet for writing paper which will provide visible guide lines in the dark, permitting a writer to write in straight lines without additional light.

In general according to my invention the backing sheet which is to be inserted under the writing paper can be provided with guide lines in two different forms. In one form, the lines can be provided by phosphorescent lines themselves, while in the other form the sheet is made phosphorescent with lines being non-phosphorescent.

A feature of the invention lies in its low cost and ease of use without need for special appliances.

Other objects and structural features which are believed to be characteristic of my invention are set forth with particularity in the appended claims. My invention, however, both in organization and manner of construction, together with further objects and features thereof may be best understood by reference to the following description taken in connection with the accompanying drawings in which:

Figure 1:
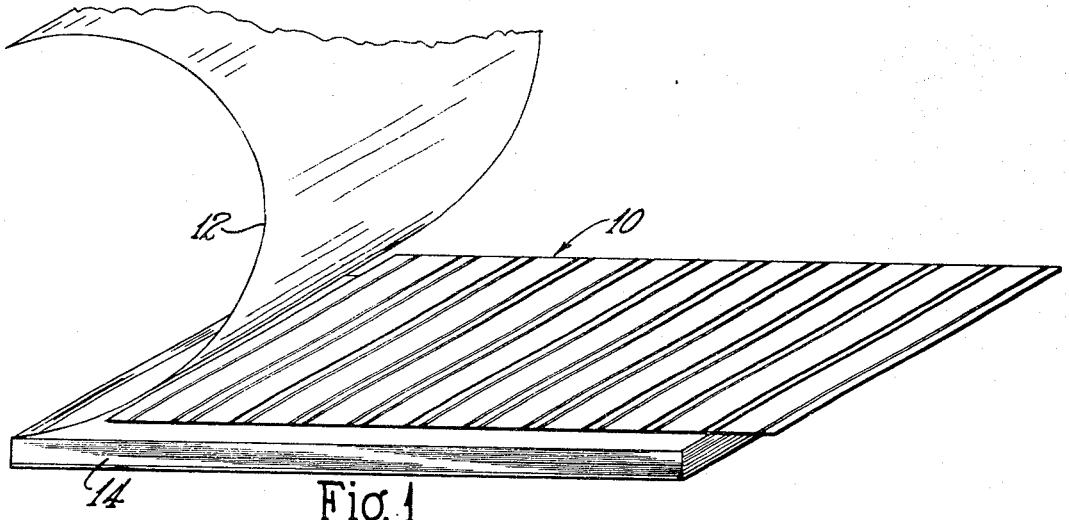
FIG. 1 is a perspective view of a writing tablet with a backing sheet of this invention in partially inserted position under the first paper sheet of the tablet.

Referring to the drawings in greater detail, FIG. 1 illustrates a tablet of writing paper 14 having a top sheet 12 lifted and turned back for insertion of a phosphorescent backing sheet 10 of my invention. As may be seen, the backing sheet can be provided with double lines or extra thick lines if desired.

Figure 2:
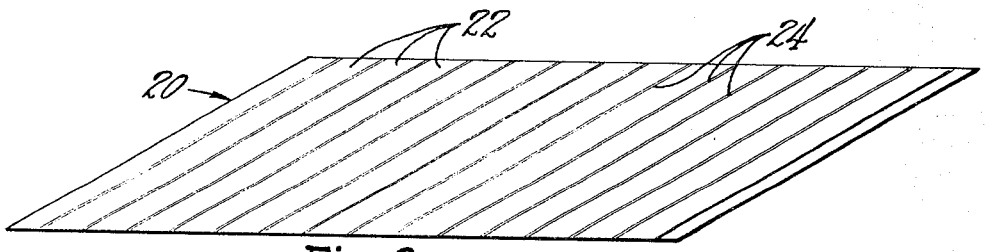
FIG. 2 is a perspective view of a phosphorescent backing sheet of this invention in which the guide lines are non-phosphorescent.

FIG. 2 illustrates a phosphorescent sheet 20 for use with the writing tablet 14 wherein the phosphorescent portions extend over the major portion of the sheet with lines 24 being non-phosphorescent. This sheet can be formed by applying phosphorescent matter in the form of paint or ink over the entire sheet with the non-phosphorescent lines being formed by the absence of phosphorescent material or by an overlay of non-phosphorescent material such as ink or narrow strips of tape. This embodiment is a preferred form of the invention in that when viewed through the writing paper, written material above the lines is visible against the phosphorescent backing.

Whether or not the writing paper backed by the luminescent sheet of the present invention is lined or unlined, the guide lines enable orderly writing in the dark where ordinarily marked lines are ineffective. Where the writing paper is unlined, sharply marked dark lines on the backing sheet over a phosphorescent base provide guides for orderly handwriting both in the presence of light or in darkness.

Figure 3:
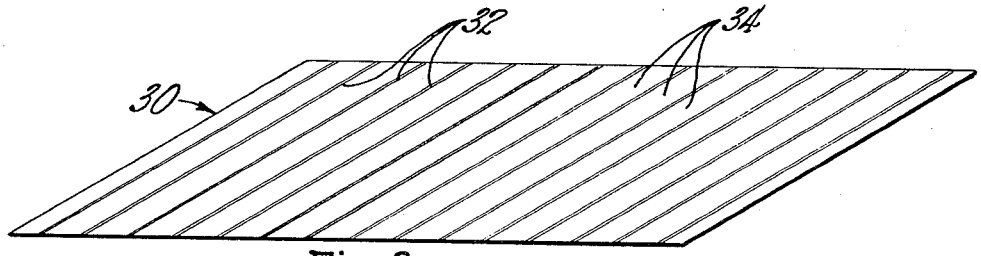
FIG. 3 is a perspective view of another embodiment of my invention in which the guide lines are of phosphorescent material.

FIG. 3 illustrates another embodiment of the invention wherein the backing sheet 30 is provided with parallel phosphorescent lines 32 while the in between portions 34 are non-phosphorescent. This form of the invention has the advantage of needing only a minimum of phosphorescent material and is accordingly inexpensive.

Figure 4:
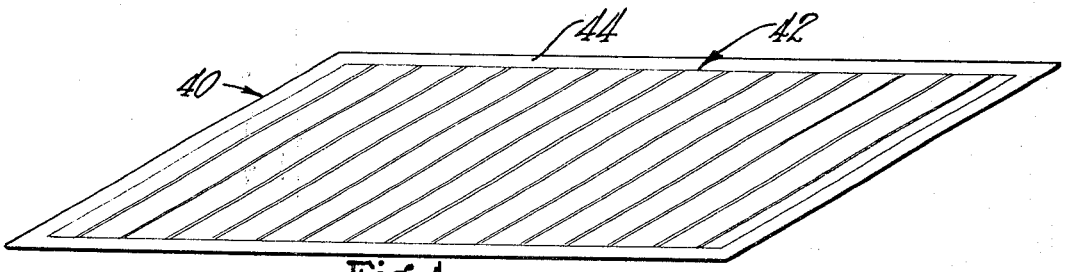
FIG. 4 is a perspective view of another form of my invention in which the phosphorescent portions are embodied in a plastic sheet.

While the phosphorescent backing sheets illustrated in FIGS. 1 to 3 may be any of a number of sheet materials such as ordinary paper, vellum, or even cloth, FIG. 4 is illustrative of a plastic sheet which may be phosphorescent material itself. It might be transluscent or transparent and thermoplastic, enabling encasement of non-phosphorescent line portions, embodied therein. It is preferably smooth and might be thicker and less flexible than the writing paper itself to facilitate easier writing thereon for greater legibility. The horizontal and marginal lines for the written material might be black or a dark color and non-phosphorescent while the remaining portions of the sheet might be of phosphorescent plastic so that the backing sheet might be utilized either day or night for guidance or handwritten material when the writing paper is placed in overlying relation thereto. That is, by making the guide lines of the plastic sheet contrastingly visible through the writing paper, the sheet can be used for guide purposes under ordinary light as well as in darkness.

To activate the phosphorescent material as a guide for writing in the dark, it is exposed to a light for a period dependent upon intensity of the light. It is found that a period of only a moment is necessary to provide an adequate charge in ordinary incandescant light or daylight to provide adequate phosphorescence for writing a period of a quarter of an hour or more.

Figure 5:
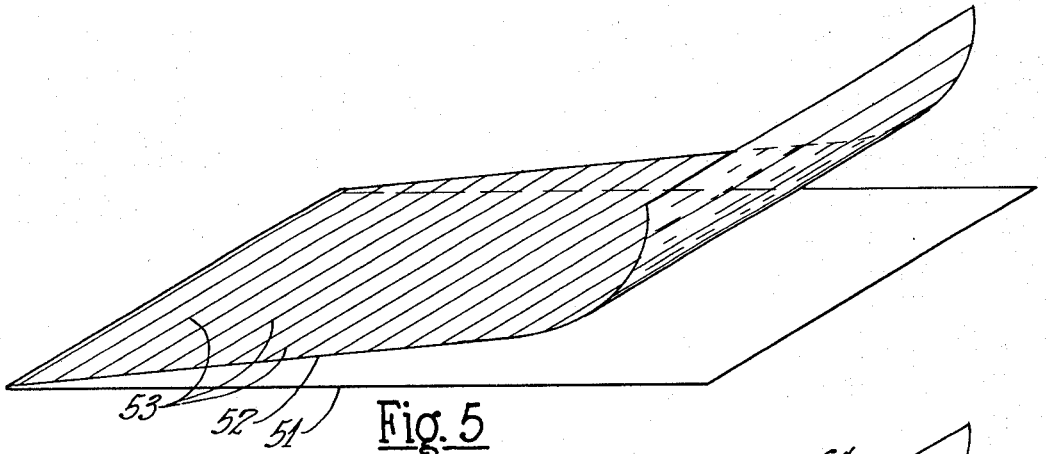
FIG. 5 is a perspective view of still another form of my invention in which guide lines are provided on a transparent sheet assembled with a phosphorescent surfaced backing sheet.
Figure 6:
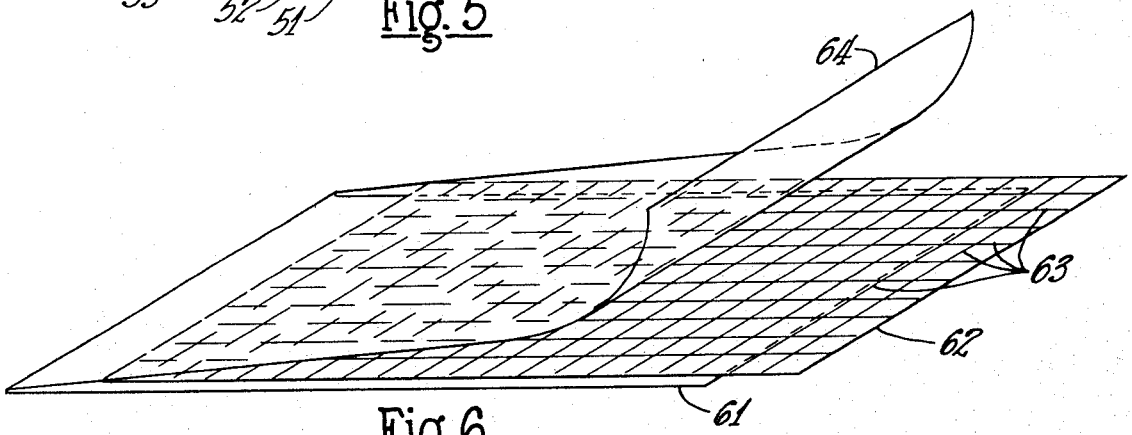
FIG. 6 is a perspective view of another assembly arrangement of my invention in which guide lines are provided on an overlay sheet interposed between a transparent top sheet and a phosphorescent surface member to which it is attached.

As still another form of the invention, a luminescent sheet 51 may be assembled as shown in FIG. 5 with a translucent or transparent overlay sheet 52 having relatively opaque guide lines 53 thereon. The assembly can be clipped, adhesively bonded or otherwise suitably secured together with the luminescent sheet, or as shown in FIG. 6 an overlay sheet 62 having guides lines 63 may be held in place between a translucent or transparent top sheet 64 such as of plastic suitably secured along one marginal or edge region of the luminescent sheet 61. This combination provides a flexibility in that the overlay sheet may be replaced with sheets having any number of guide line arrangements for combination with the phosphorescent sheet, while at the same time being readily placed under writing sheets for guiding application of matter thereto in the dark.

For example, vertical and horizontal guide lines or guide lines in the form of grids may be applied to the overlay sheet to permit application of intelligible matter in columns or writing paper in the dark. Still further, block sections of relatively opaque material might be provided on the overlay sheet to indicate pre-selected areas on writing paper or sheets which are not used while intelligible matter is applied to other areas in the dark. Figures or drawings might also be applied to the overlay sheet to provide guide lines for drawing pictures in the dark. In addition a number of games can be devised for playing in the dark and magic tricks can be devised based upon the performer's or audiences ability to observe material in the dark.

Still further, the underlying phosphorescent surface might be provided with non-phosphorescent regions which cooperate with the various opaque lines on the overlay sheet. The light passing overlay sheet can also be provided with phosphorescent guide lines or guide areas of luminescent material giving off light of different and contrasting color from the light given off by the underlying surface. Thus where a standard framework is desired for guiding the application of intelligible matter on writing or drawing sheets, a number of different opaque or luminescent guide line arrangements or grids can be cooperatively associated with the framework set out by the phosphorescent sheet to provide order to a series of sheets on which intelligible matter can be applied with the guide line combinations.

In regard to the foregoing reference herein to written material being visible against the phosphorescent backing, it has been found that reading matter can be readily read in complete darkness if the letters of the reading matter have a sufficient body to be silhouetted against the luminescent background. Thus if handwritten matter is written with a thick line, such as with a felt tip pen, or if printed matter is in letters having line thicknesses providing a bold appearance, reading matter can be read readily against a luminescent background both in lighted as well as in dim and dark spaces. The reading matter if on an overlay sheet of light transmitting material, such as a translucent or a transparent sheet, can thus be read readily in dark spaces such as in hospitals, laboratories or on menus in dimly lit restaurants.

Figure 7:
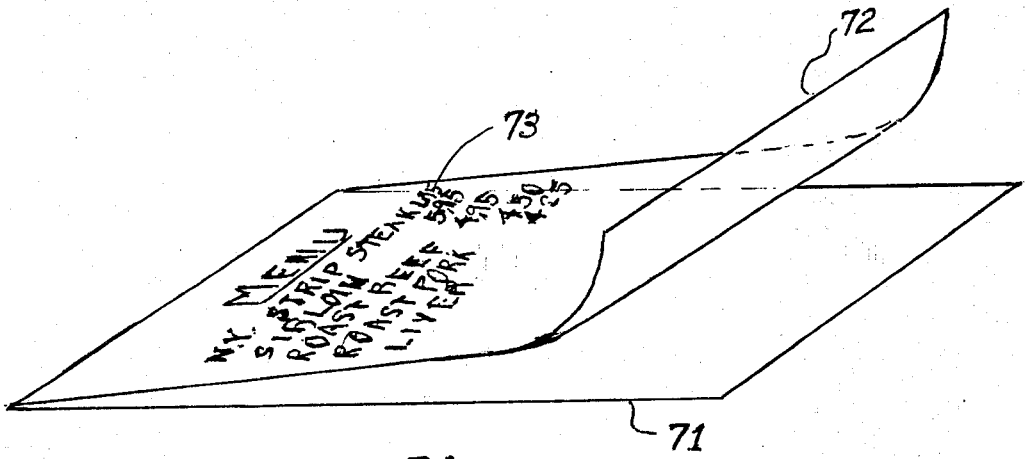
FIG. 7 is a perspective view of still another assembly of my invention in which reading matter is provided on a transparent sheet overlaying a phosphorescent surfaced member.

As illustrated in FIG. 7, the letters 73 of the reading matter on the light transmitting overlay sheet 72 may be of ordinary non-glowing matter in black or in color which will provide a ready contrast against the reflective color of the luminescent backing 71 in lighted spaces. It is well known in physics that light is invisible in space and made visible only when transmitted or reflected from a surface. In this regard, where light is present in a space, the reflective color character of the matter to be read in such light can be selected for the desired contrast against the reflective color of the luminescent background sheet in such light. Colors of the letters can thus be selected for their contrasting visibility in ordinary light but in addition, where the reading matter is to be read in dim light or in darkness, the thickness of the lines of the letters are selected so that they can be seen in silhouetted form against the luminescent background. In such case the ordinary non-glowing reading matter will appear black against the luminescent background regardless of its color in ordinary light. I have found that letters written with a line thickness greater than from a little under one sixteenth inch width and letters printed in 24 point letter sizes and greater will provide silhouetted forms which can be read quite clearly in darkness against a luminescent background. In this regard, printing such as for menus it has been found provides satisfactory visibility in the dark when in the range of 24–72 point print.

As an alternate to such letters of reading matter being of non-glowing material fluorescent material can be utilized for the letters entirely or to outline or to interlineate letters or other intelligible matter. Thus when such matter is to be seen in ordinary light, the fluorescent matter will stand out clearly for ease of reading and distinguishability. When contrasting fluorescent letters are seen in darkness, however, the fluorescent materials in being non-activated, will appear black and silhouetted against the glowing luminescent backgrounnd.

As still another arrangement for ease of reading or greater clarity in darkness, the intelligible matter can be made with phosphorescent material having a contrasting reflective color in ordinary light against the reflective color of the luminescent backing material. The phosphorescent material of the matter can also be selected for its contrasting luminescent color against the color of the background glow. Still further in this regard, matter in phosphorescent lettering might be outlined or interlineated with fluorescent material. The phosphorescent material in darkness then will be readable because of its contrast in luminescent color and the fluorescent material will appear black rather than in its activated color condition. Non-luminescent outline material or interlineated non-luminescent material can also be utilized to highlight fluorescent or phosphorescent letters in reflective light.

In all such arrangements the contrast and thickness of lines of lettering to be utilized on the overlay sheet with the luminescent background it has been found will make reading in the dark possible with greater ease while at the same time providing a flexibility in selection of materials and colors such that the contrast for distinguishing clarity and ease of reading in reflective light is also possible.

My above described arrangement has the feature that when printed reading matter is incorporated in a form such as a menu, a light transmitting overlay on which the reading matter is applied can be readily replaced over the more expensive luminescent backing surface. The luminescent assembly thus can need only use a single luminescent backing surface while the overlay menu sheet can be changed inexpensively with each meal change. The replacement sheets can be readily printed on transparent or translucent material in a conventional duplicating machine. The sheets can be of material such as vinyl and can be associated with phosphorescent backing surface in a simple holding assembly. In this regard, the holding assembly might be a luminescent backing provided with an overlying outer transparent face which in a sense forms an envelope within which the printed sheet can be merely slipped for use according to the principles of the present disclosure.

The menu can be activated by an ordinary lamp and more so by an ultraviolet lamp. Then when in use in a space desired to be dimly lit, it has been found that a remotely located bulb such as a fluorescent or ultraviolet light bulb is helpful in holding already activated phosphorescent matter activated at a desirable level to highlight the reading matter. When the reading matter is then turned away from a position of exposure to such light energy, the phosphorescence of the backing surface makes the printed matter still visible in black silhouetted form against the luminescent backing surface.

Beside reading material on an overlay sheet thus being visible as set out above, sketches and images and other intelligible matter such as graphs and grids can also be seen more readily according to the principles set out above.

Still further, phosphorescent matter having different rates of decay can be resorted to to provide the capability of reading and writing in darkness. In this regard fluorescent and phosphorescent materials having different luminescent decay rates can be incorporated into images to form a composite of the overlay and backing sheet to impart apparent motion to the image. Further in this regard two or more phosphorescent colored materials, or two, three or more fluorescent and phosphorescent materials of different decay rates can be incorporated into an image with very unusual visual results.

Intelligible matter can also be applied to an overlay sheet or on the luminescent surface itself with fluorescent matter matched in its activated and reflective color to the color of the luminescent surface. The fluorescent material thus can be made to blend in with the luminescent background and not be visible when activated such as by a light source. It can be made visible as dark silhouetted matter against the luminescent surface, however, by removing it from exposure to the activating source. This principal of invisibility during activation and visibility in darkness when not activated can also be inverted by blending the color of phosphorescent matter in with a fluorescent background during exposure to an activating source and the continuing glow of the phosphorescent material can be made visible in darkness in contrast to the non-glowing fluorescent material not under the influence of an activating source.

Although the light emitting substance is referred to herein as "phosphorescent material", it will be understood that the invention may utilize any of a number of substances which will glow or emit light and accordingly the terminology "phosphorescent material", as used herein is meant to include chemiluminescent and bioluminescent materials and any substance which will emit light without any apparent rise in temperature after exposure to a stimulus such as heat, light, or electric current, voltage, discharge and signals.

In view of the foregoing it will be understood that many variations of the arrangement of my invention can be provided within the broad scope of principles embodied therein. Thus, while particular preferred embodiments of my invention have been shown and described, it is intended by the appended claims to cover all such modifications which fall within the true spirit and scope of the invention.

I claim:

1. A luminescent backing assembly for making intelligible matter visible in darkness comprising;

a backing member having a luminescent glow surface, an overlay sheet of material through which luminescent glow light can pass overlying said backing surface, said overlay sheet having intelligible matter thereon comprising contrasting luminescent reading matter of different activated color from said luminescent surface and which in combination with said luminescent surface causes said matter to be silhouetted against said luminescent surface and visibly discernable in the dark.

2. A luminescent backing assembly as set forth in claim 1 wherein the intelligible matter comprises letters of reading matter comprising fluorescent material.

3. A luminescent backing assembly as set forth in claim 1 wherein said luminescent surface and intelligible matter comprise phosphorescent materials having different decay rates.

4. A luminescent backing assembly as set forth in claim 1 wherein the intelligible matter comprises reading matter written in fluorescent material of contrasting reflective color.

5. A luminescent surface member adaptable to making intelligible matter visible in darkness comprising;

a surface having intelligible matter defined by phosphorescent and fluorescent materials, said phosphorescent and fluorescent materials having matched activated glow colors such that neither is substantially visible against the other when activated and upon removal from influence of the activating source, the phosphorescent material will continue to glow while said fluorescent material ceases to glow.

6. A luminescent surface member as set out in claim 5 wherein one of said materials defining the intelligible matter is on a light passing member overlying a surface carrying the other of said materials.

* * * * *